US005704190A

United States Patent [19]

Kaneko et al.

[11] Patent Number: 5,704,190

[45] Date of Patent: Jan. 6, 1998

[54] FILLING APARATUS AND PACKAGING MATERIALS

[75] Inventors: Masamichi Kaneko; Jan Papina, both of Tokyo, Japan

[73] Assignee: Tetra Laval Holdings & Finance, S.A., Switzerland

[21] Appl. No.: 553,493

[22] PCT Filed: Jun. 23, 1994

[86] PCT No.: PCT/JP94/01004

§ 371 Date: Nov. 20, 1995

§ 102(e) Date: Nov. 20, 1995

[87] PCT Pub. No.: WO95/00393

PCT Pub. Date: Jan. 5, 1995

[30] Foreign Application Priority Data

Jun. 23, 1993 [JP] Japan ..... 5-152352

[51] Int. Cl.[6] ..... B65B 3/26; B65B 57/00; B65D 81/24

[52] U.S. Cl. ..... 53/51; 53/131.2; 53/135.2; 53/141; 53/168; 53/505; 428/900

[58] Field of Search ..... 53/51, 55, 52, 53/505, 131.2, 131.4, 131.5, 64, 135.3, 135.2, 141, 168; 283/82; 428/611, 900

[56] References Cited

U.S. PATENT DOCUMENTS

| | | | |
|---|---|---|---|
| 3,684,869 | 8/1972 | Beiter | 235/61.12 M |
| 3,787,001 | 1/1974 | Henry | 53/51 X |
| 3,861,983 | 1/1975 | Harrell | 53/51 X |
| 4,018,029 | 4/1977 | Safranski et al. | 53/502 X |
| 5,390,470 | 2/1995 | Brunini et al. | 53/168 X |
| 5,537,798 | 7/1996 | Fukuda et al. | 53/168 X |

FOREIGN PATENT DOCUMENTS

| | | |
|---|---|---|
| 3275403 | 6/1991 | Japan . |

*Primary Examiner*—James F. Coan
*Attorney, Agent, or Firm*—Lorusso & Loud

[57] ABSTRACT

To simplify the operation of an input unit of a filling apparatus and achieve accurate filling of packaging containers with a liquid food. The filling apparatus includes a read-out unit which reads out packaging material information from a magnetic recording medium layer mounted on the packaging material, a sealing unit for sealing the packaging material, and a filling unit for charging the liquid food supplied thereto. Also included is a filling unit controller, which outputs control signals to the sealing unit and the filling unit in accordance with a predetermined program based on the packaging material information and liquid information sent from the read-out unit. The filling apparatus reads out necessary packaging material information from the magnetic recording medium layer at the time of filling, and charges the liquid food in accordance with the packaging material information and liquid information, and seals the packaging material.

7 Claims, 6 Drawing Sheets

FILLING APARATUS AND PACKAGING MATERIALS

TECHNICAL FIELD

The present invention relates to a filling apparatus and a packaging material.

BACKGROUND ART

Conventionally, brick-shaped packaging containers used for carrying liquid foods such as milk and soft drinks have been manufactured to a manner into which a web-like packaging material is first formed in a tubular shape, and then into a final shape while charging a liquid food therein.

In detail, the packaging material is first formed into a tubular shape by sealing it in the longitudinal direction to obtain a tubular packaging material, and the obtained tubular material is continuously transferred downward while a liquid food is supplied into it from its top. Then, while both sides of the tubular packaging material are supported by sealing jaws, the tubular packaging material is sealed laterally with a prescribed spacing to obtain a series of sealed compartments each of which has a rectangular shape such as a pillow or a bag.

In the next step, the tubular packaging material is cut at the portions corresponding to the lateral seals (hereinafter referred to as "lateral seal portion") and separated to obtain a plurality of finished packaging containers each of which contains a prescribed amount of liquid food.

In the case of gable-top containers, the packaging material is first cut into pieces of a predetermined shape which are sealed lengthwise to form a hollow column with a square cross-section. Subsequently, the bottom part of the column is shaped by a forming machine to obtain a box, and the top part is sealed after the liquid food is charged into the box, thereby forming a complete packaging container.

In a filling apparatus, a wide variety of liquid foods are filled in various packaging containers of different shapes and of different materials. In order to accommodate these varied conditions, the operator of the filling apparatus must input into the input unit of the filling apparatus both package information corresponding to the packaging material and liquid information corresponding to the liquid food.

When a roll of packaging material is loaded on the filling apparatus, the operator sets the operating conditions of the apparatus according to the specifications of the packaging material, while making records of the specifications of the packaging material and the liquid information, while adjusting sealing time, sealing temperature, and sterilization conditions.

Thus, a particular packaging container which contains a specified liquid food in a specified packaging material will be prepared.

However, it is very cumbersome to operate the input unit of the conventional filling apparatus. It is required not only to specify the packages material and the liquid food by inputting packaging material information and liquid information to the input unit so as to set a filling process program corresponding to the packages material and the liquid food, but also to adjust the operating conditions by inspecting the shape of completed packages even when the same packages material is to be used, since the material differs slightly in each lot.

Furthermore, it is difficult to adapt to complaints about products and to guarantee the product quality when conventional packaging materials are used, because it is impossible to identify the packaging container from the packaging material used or to trace its distribution route.

An object of the present invention is to overcome the aforementioned problems of the conventional apparatus and to provide a filling apparatus and packaging materials which can simplify the operation of the input unit while achieving accurate filling of packaging containers with liquid foods.

DISCLOSURE OF THE INVENTION

For achieving the above objects, the filling apparatus of the present invention comprises a read-out unit for reading out packaging material information regarding a packaging material from a magnetic recording medium layer formed on the packaging material, a sealing unit for sealing the packaging material, a filling unit for charging a liquid into the package and a memory for storing liquid information about the liquid.

Also included in this apparatus is a filling unit controller which reads out the liquid information from the memory and outputs control signals to the sealing unit and the filling unit in accordance with a predetermined program based on the liquid information and packaging material information sent from the read-out unit.

When filling a packaging container with a liquid food, the filling apparatus reads out the liquid information from the memory and the packaging material information from the magnetic recording medium layer, fills the packaging container in accordance with the liquid information and packaging material information, and then seals the packaging material. Thus, there is no need to manually input the liquid information and packaging material information to the filling unit. This simplifies the operation of the input unit and also allows accurate filling of the packaging container with the liquid food.

In another embodiment of the present invention, the filling apparatus is equipped with a writing unit which receives from the filling unit controller packaging container information regarding the packaging container and inscribes the information into the magnetic recording medium layer. The packaging material on which the packaging container information has been inscribed is transferred to the sealing unit for sealing and is filled with a liquid food by the filling unit.

This makes it possible to read out the packaging material information from the magnetic recording medium layer of the package, allowing identification of the packaging material and tracing of its distribution route, so that it is easier to accommodate complaints about products and guarantee product quality.

The packaging material of the present invention comprises a supporting substrate, and thermoplastic resin layers formed both on the inner and outer package surfaces of the supporting substrate, which serve as sealant layers with each other. In the packaging material, a magnetic recording medium layer made of a magnetic material is formed on the surface of the supporting substrate and inner side of one of the thermoplastic resin layers.

With this configuration, the packaging material information regarding packaging materials and the packaging container information regarding packaging containers can be inscribed on the magnetic recording medium layer. Therefore, the packaging material information can be retrieved from the magnetic recording medium layer. This simplifies the operation of the input unit because there is no need to manually input the packaging material information to the filling apparatus. Likewise, this makes it possible to read out the packaging container information from the magnetic recording medium layer of the package, allowing identification of the packaging container and tracing its distribution route, so that it is easier to accommodate complaints about products and guarantee product quality.

According to another embodiment of the packaging material of the present invention, the magnetic recording medium layer is formed on the inner package surface of the supporting substrate, and the magnetic material has electric conductivity.

In this case, the packaging material can be sealed by induction heating of the magnetic recording medium layer, i.e., the magnetic recording medium layer can also be used as a part for sealing portion.

BEST MODE FOR CARRYING OUT THE INVENTION

Now, preferred embodiments of the present invention will be described in detail referring to the accompanying drawings.

Figure 1:
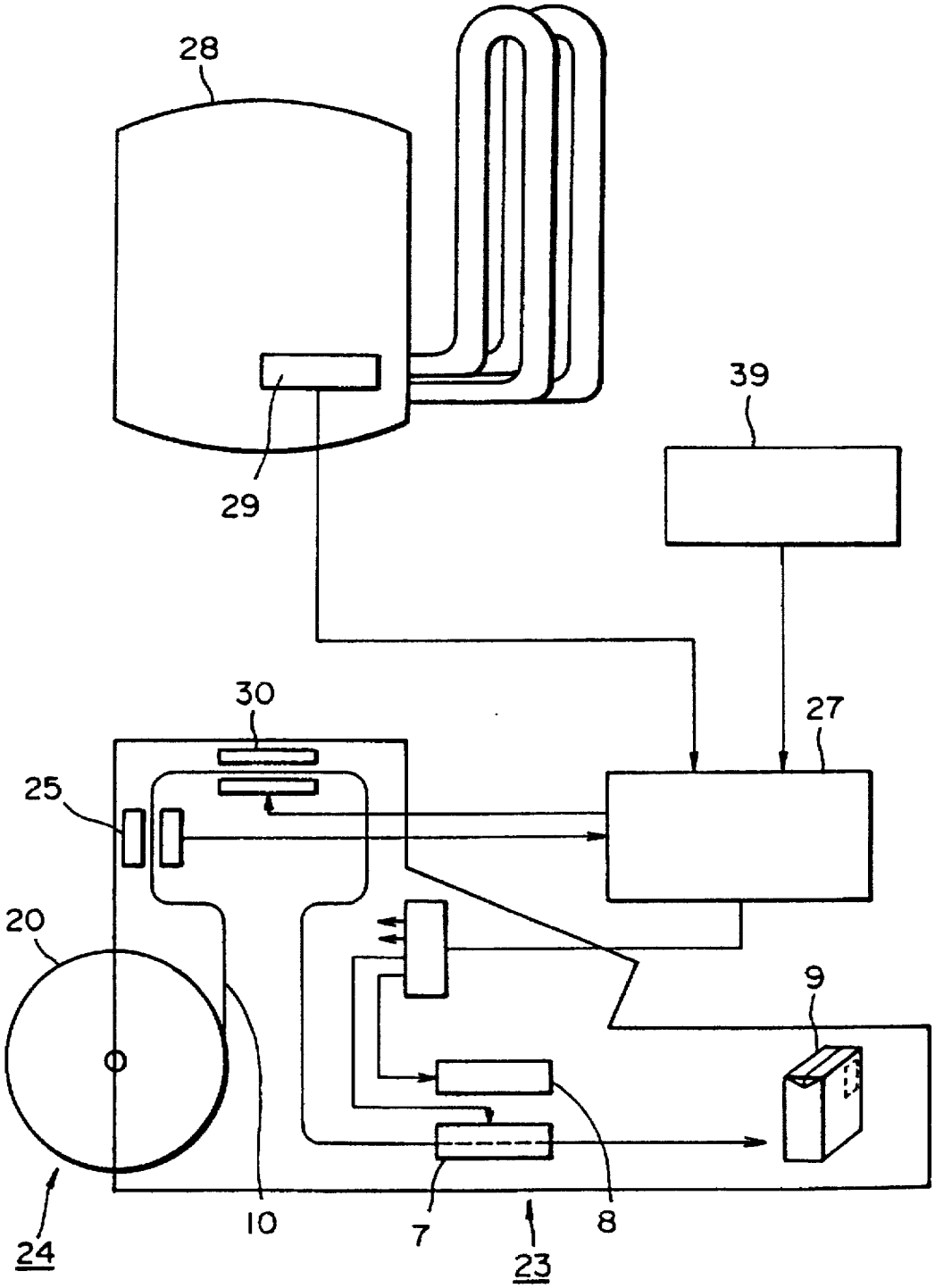
FIG. 1 is a schematic view of a filling apparatus showing a first embodiment of the present invention.
Figure 2A:
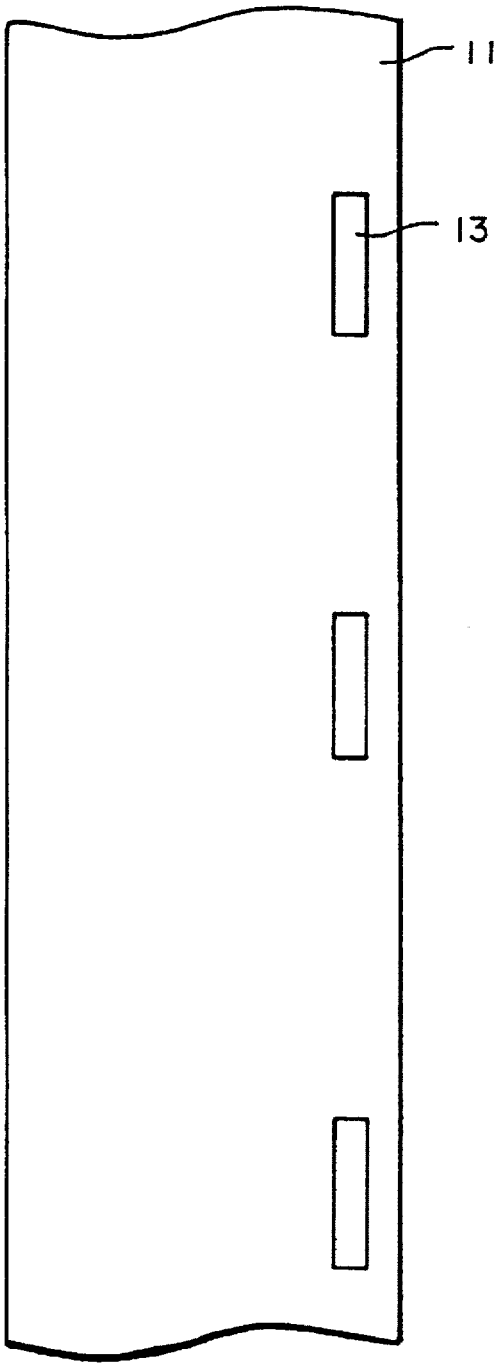
FIG. 2(*a*) is a plan view of a paper substrate of the packaging material used in the first embodiment of the present invention, and FIG. 2(*b*) is a cross-sectional view of the packaging material.
Figure 2B:
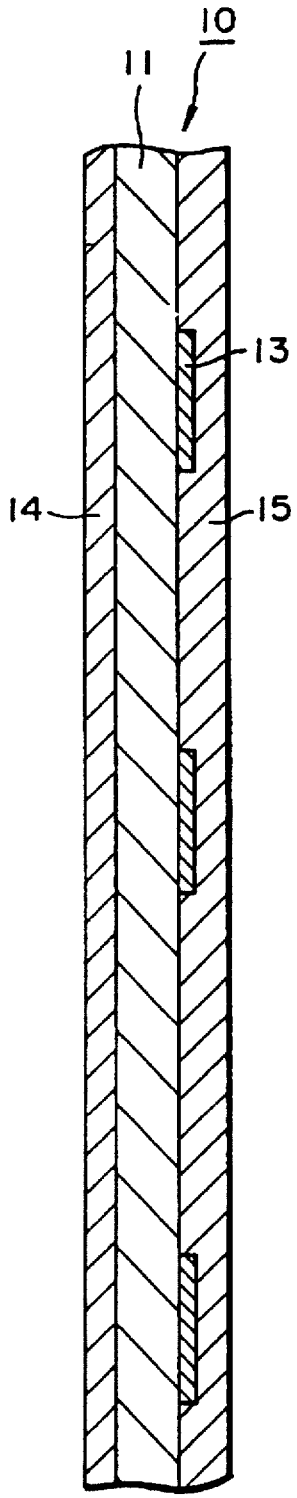
Figure 3:
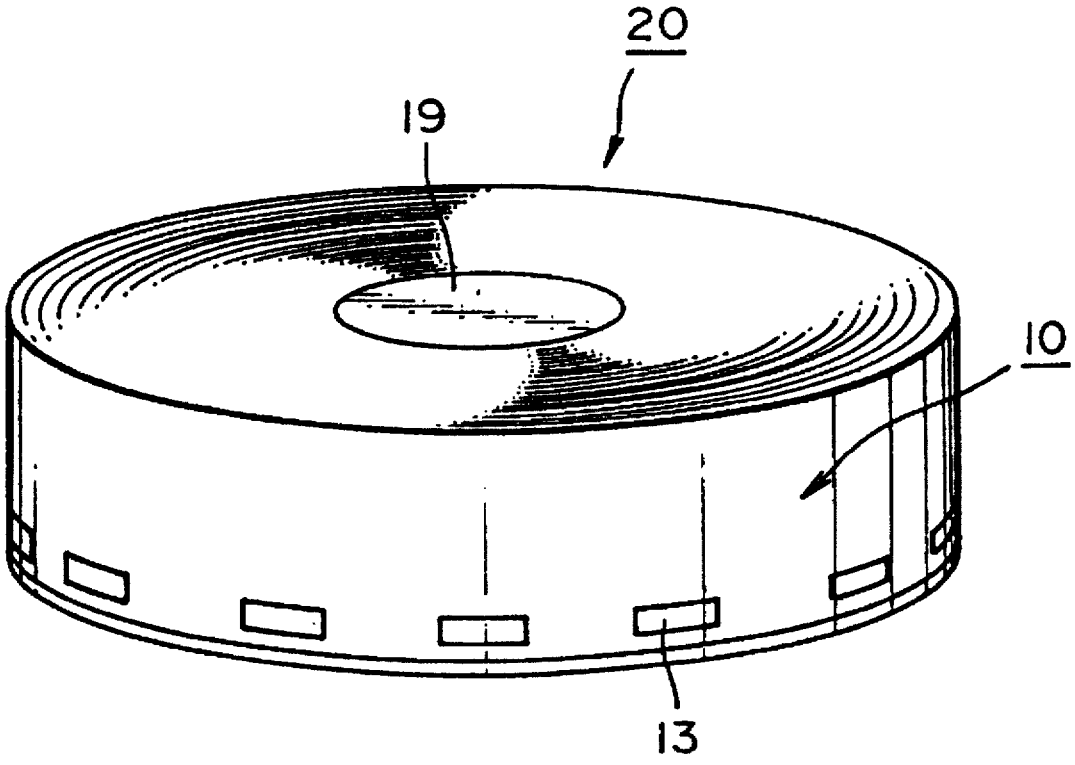
FIG. 3 is a perspective view of a roll of a packaging material used in the embodiment of the present invention.

FIG. 1 is a schematic view of a filling apparatus showing a first embodiment of the present invention, FIG. 2 is a schematic view of a packaging material used in the first embodiment of the present invention, and FIG. 3 is a perspective view of a roll of a packaging material used in the embodiment of the present invention. In FIG. 2, section (a) shows a plan view of a paper substrate of the packaging material, while section (b) is a cross-section of the packaging material. In this embodiment, the case is described where a liquid food is placed in a brick-shaped container made of a tubular packaging material, In these drawings, numeral 10 denotes a packaging material, numeral 11 denotes a paper substrate composed of cardboard and supporting the packaging material 10, and numeral 13 denotes a magnetic recording medium layer, which is a partially overlaid magnetic material on the surface of the paper substrate 11 which will be become the outer surface of a packaging container 9 (hereinafter referred to as "outer package surface"). In the printing process of the packaging material 10, a certain printing is effected on the outer package surface of the paper substrate 11. The magnetic recording medium layer 13 may be formed after the printing process.

On the surface of the paper substrate 11 which will becomes the inside surface of the packaging container 9 (hereinafter referred to as "inner package surface"), a thermoplastic resin layer such as polyethylene layer 14 is formed. On the outer package surface of the paper substrate 11 on which the magnetic recording medium layer 13 has been formed, another thermoplastic resin layer such as polyethylene layer 15 is formed so as to cover the magnetic recording medium layer 13, thereby completing a web-like packaging material 10. The polyethylene layers 14 and 15 serve as sealant layers for sealing the packaging material 10 when the packaging container 9 is formed.

When a gas-barrier property is required, an additional resin layer composed of ethylene vinyl alcohol copolymer (EVOH), polyvinylidene chloride (PVDC), polyester (PET), Nylon (Trade Mark) or the like may be formed between the polyethylene layer 14 and the paper substrate 11, or a film evaporated with oxidized silicon (SiOx) may be adhered thereto.

Since the magnetic recording medium layer 13 is required to be present on each packaging container 9, it is formed in a band shape of certain length at predetermined intervals on the web-like packaging material 10, as shown in FIG. 2.

When making the packaging container 9, the web-like packaging material 10 is first wound around a core 19 to form a roll 20, as shown in FIG. 3, which will be loaded on a supply unit 24 of the filling apparatus 23. The packaging material 10 has the magnetic recording medium layers 13 at the prescribed positions on the inner package surface of the paper substrate 11, and the magnetic recording medium layers 13 can be seen through the polyethylene layer 15. Packaging material information including, for example, specifications of the packaging material 10 such as material and dimensions of the packaging material 10, machine used for manufacturing the packaging material 10, the method of forming the packaging material 10, kind of the liquid food to be placed in the packaging container 9, etc., are recorded beforehand on the magnetic recording medium layers 13 by a recording device (not shown in the drawings) in another plant.

In the aforementioned filling apparatus 23, the loaded packaging material 10 is formed into a tubular shape, into which a liquid food is placed by a filling unit 8, and then the tubular package is sealed by a sealing unit 7 to complete the packaging container 9.

During this process, the packaging material 10 is delivered from the supply unit 24 and transferred to a read-out unit 25. The read-out unit 25 equipped with a read-out head (not shown in the drawing) reads out the packaging material information including, for example, specifications of the packaging material 10 such as the material and dimensions of the packaging material 10, machine used for manufacturing the packaging material 10, the method of forming the packaging material 10, kind of the liquid food to be placed in the packaging container 9. This packaging information is sent to a filling unit controller 27.

A liquid food is stored in a sterilizing tank 28. The liquid information regarding the liquid food includes specifications of the liquid food, supply conditions such as temperature and pressure of the liquid food when the liquid food is supplied to the filling apparatus 23, processing conditions of the liquid food, and the like. The liquid information is stored in a memory 29, and is sent to the filling unit controller 27.

Upon receiving these packaging material information and liquid information, the filling unit controller 27 sends packaging container information such as operating conditions of the filling apparatus, etc. to a writing unit 30. Upon receiving the packaging container information, the writing unit 30 erases aforementioned packaging material information and liquid information from magnetic recording medium layer 13 and records the packaging container information.

Alternatively, in the writing unit 30, the packaging container information may be overwritten without erasing the packaging material information and liquid information.

Such packaging container information includes, for example, manufacture lot No. of the packaging container 9, date of manufacture, the order of manufacture, the number of a manufacturing apparatus, etc. This information will be read out by other read-out devices after the products have been put on distribution routes. It facilitates not only identification of each packaging container 9, but also makes it possible to trace the distribution route, thereby making it easier to accommodate complaints about products and guarantee product quality. In the drawing, numeral 39 denotes an input unit for changing the conditions of the program for filling process such as sealing time duration, sealing temperature, and the like.

After the packaging container information has been written on the magnetic recording medium layer 13, the packaging material 10 is sealed in the longitudinal direction by the sealing unit 7 to obtain a tubular packaging material. This tubular packaging material 10 is continuously transferred downward. Then the liquid food supplied from the sterilizing tank 28 is charged in the tubular packaging material 10 from its top by the filling unit 8. Subsequently, the tubular packaging material 10 is sealed along a lateral or transverse direction with a predetermined spacing to form sealed compartments successively, while both sides of the tubular packaging material are supported by sealing jaws (not shown) of the sealing unit 7.

During this process, the aforementioned filling unit controller 27 outputs control signals to the sealing unit 7, liquid food metering unit (not shown), sterilizing unit, etc., according to the packaging material information, liquid information, and the preset filling process program so as to charge the liquid food and to adjust the sealing time, sealing temperature, sealing pressure, and sterilization conditions.

Since the sealing unit 7, the filling unit 8 and the like can be controlled in accordance with the packaging material information, an erroneous loading in which a wrong packaging material is set to the supply unit 24 can be detected. This eventually prevents errors in sealing and filling.

In addition, if a plurality of the filling unit 8 are installed, it is possible to fill any different liquid food to each packaging container using the same packaging material 10 by selecting a filling unit 8 in accordance with the packaging material information.

Finally, the tubular packaging material 10 is cut at the lateral sealing portions to obtain a plurality of brick-shaped containers each containing a specified amount of liquid food.

The aforementioned magnetic recording medium layer 13 is made of a material which is easily magnetized. In this embodiment, a magnetic ink prepared by mixing a magnetic compounds such as $Fe_2O_3$, $Fe_3O_4$, or barium ferrite into a resin such as urethane is used.

The magnetic ink is applied on the paper substrate 11 by a known printing method or a coating technique such as silk-screen printing, offset printing, gravure printing, etc. to form the magnetic recording medium layer 13. The shape and dimensions of such magnetic recording medium layer 13 varies depending on the amount of information to be recorded. The position of the layer 13 on the paper substrate 11 also depends on the kind of the packaging container 9.

The thickness of the magnetic recording medium layer 13 is selected between a few and a dozen microns. When the magnetic recording medium layer 13 is formed by the aforementioned printing technique, single printing process cannot produce a layer of magnetic material having a sufficient thickness, though the thickness of the magnetic material layered formed by a single printing process varies depending on the kind and density of a magnetic compound to be used. Hence, the magnetic recording medium layer 13 is usually formed by repeating such printing process several times.

Next, the method of offset printing for forming the layer of magnetic ink on the paper substrate 11 will be explained with reference to FIG. 4 and FIG. 5.

Figure 4:
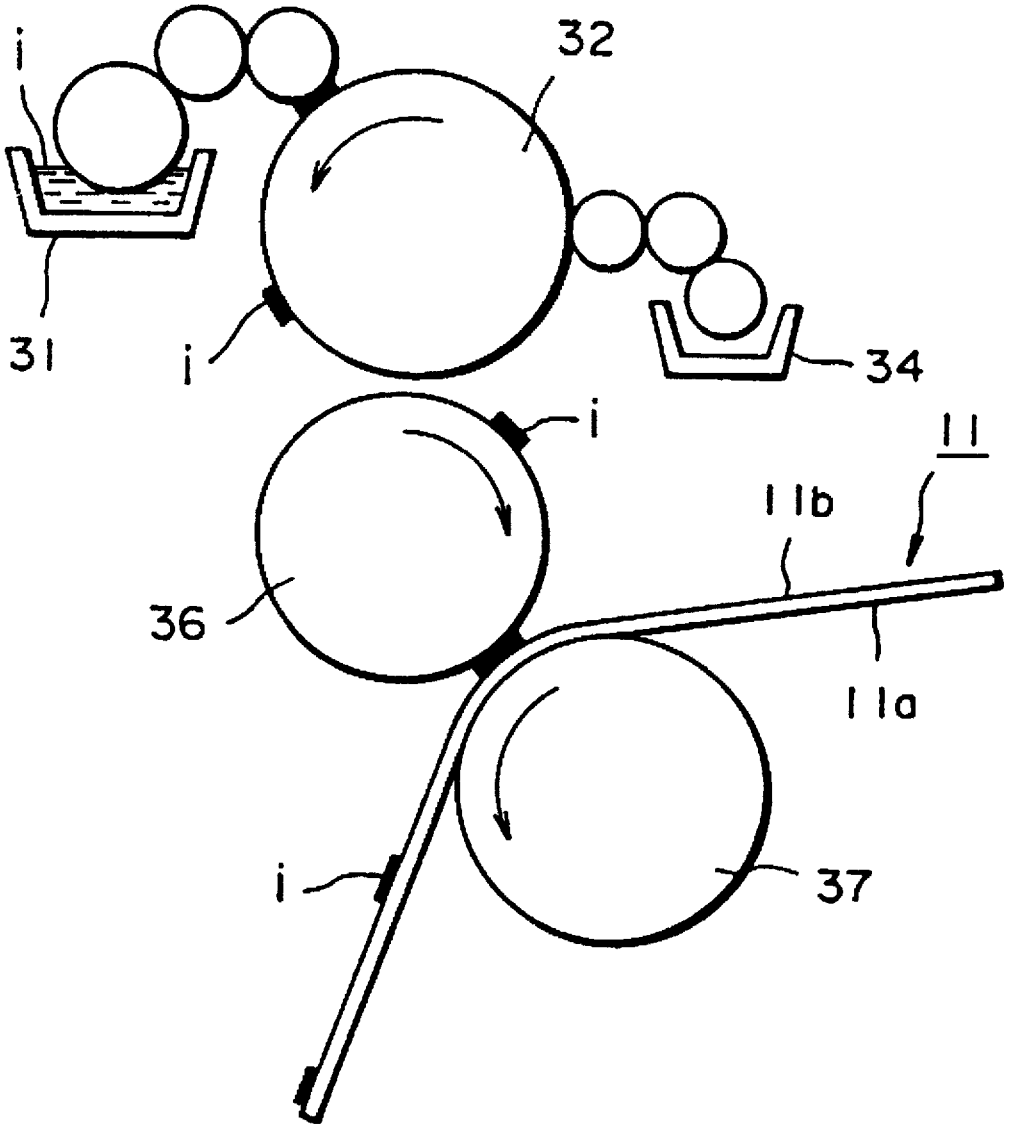
FIG. 4 is a schematic illustration showing offset printing.
Figure 5:
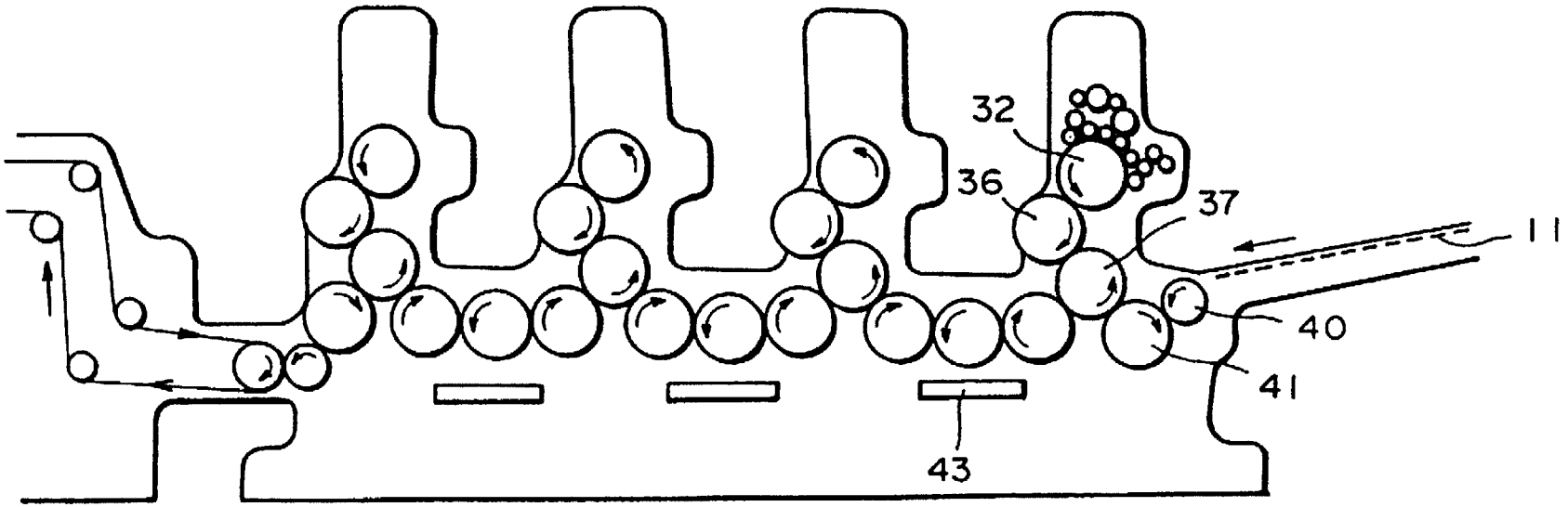
FIG. 5 is a schematic illustration showing offset printing comprising several printing steps.

FIG. 4 is a conceptual illustration showing offset printing, while FIG. 5 is a conceptual illustration showing offset printing comprising several printing steps.

In FIG. 4, numeral 11 denotes a paper substrate, numeral 11*a* is the inner package surface of the paper substrate 11, numeral 11*b* is the outer package surface of the paper substrate 11, numeral 31 denotes a ink tank which stores the magnetic ink i, numeral 32 denotes a printing roller which constitutes a printing plate, on which lipophilic portions each having a shape corresponding to the sealing portion are formed at predetermined intervals. Numeral 34 denotes a water-wetting unit which moistens a part of the printing roller other than the lipophilic portions. The aforementioned magnetic ink therefore adheres solely to the lipophilic portions.

Numeral 36 denotes a rubber roller contacting the printing roller 32. The magnetic ink adhering to the printing roller 32 is transcribed to the rubber roller 36. A pressure roller 37 is disposed to contact the rubber roller 36, between which the paper substrate 11 is supplied. The paper substrate is supplied such that the outer surface 11*b*, on which certain printing has been placed, will face to the rubber roller 36.

When the paper substrate 11 passes between the rubber roller 36 and the pressure roller 37, the magnetic ink i is overlaid on the outer package surface 11*b* of the paper substrate 11, and thus the first printing step will be finished.

Referring to FIG. 5, numeral 11 denotes the paper substrate 11, numeral 32 denotes the printing roller, numeral 36 is the rubber roller, numeral 37 is the pressure roller, numeral 40 is a paper supply roller, numeral 41 is a delivery roller, and numeral 43 is a dryer which dries the magnetic ink i overlaid on the paper substrate 11.

As illustrated in the drawing, the printing and drying steps are repeated for several times to uniformly apply the magnetic ink i on the outer package surface 11*b* of the paper substrate 11 with a required thickness. In this manner, the magnetic recording medium layer 13 is formed.

The magnetic ink i of this kind is difficult to be uniformly dried and hardened. Besides, repetitive drying of the magnetic ink i after each printing step will denature the paper substrate 11 due to the weak thermal stability of the substrate. For this reason, the temperature for drying cannot be high, so that the duration for drying tends to be longer. To avoid these problems, the magnetic recording medium layer 13 can also be formed on the paper substrate 11 by adopting a leaf-putting technique, without overlaying the magnetic ink i directly on the outer package surface 11*b* of the paper substrate 11.

The method of overlaying the magnetic ink i on the paper substrate 11 by means of leaf-putting technique will be explained with reference to FIG. 6.

Figure 6:
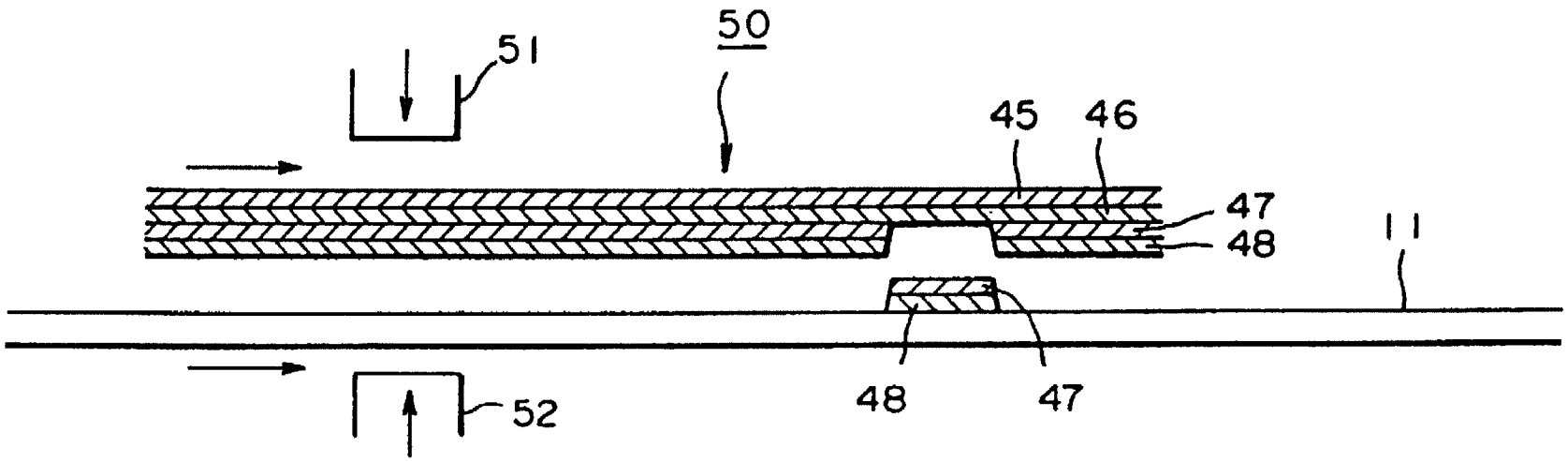
FIG. 6 is a schematic illustration showing leaf-putting technique.

FIG. 6 is a conceptual illustration showing the leaf-putting technique.

In the drawing, numeral 45 is a base film used as a carrier, numeral 46 is a releasing agent layer formed on the surface of the base film 45, numeral 47 denotes a magnetic ink layer formed on the releasing agent layer 46 with a thickness of several to a dozen microns. The magnetic ink layer 47 is formed on the paper substrate 11 by applying the magnetic ink i by repeating printing and drying steps for several times. Numeral 48 denotes a heat-sensitive adhesive layer formed on the surface of the magnetic ink layer 47.

This leaf-putting film 50 having a laminated structure is prepared in a separate process and is placed facing the paper substrate 11 and transferred in the same direction at the same speed as the paper substrate. When the leaf-putting film 50 and the paper substrate 11 are heated and pressed by a heating/pressing bar 51 and a counter bar 52, only the aforementioned magnetic ink layer 47 and the heat-sensitive adhesive layer 48 are detached from the releasing agent layer 46 and transcribed on the paper substrate 11. The magnetic recording medium layer 13 is thus formed on the paper substrate 11.

In this case, the base film 45 has a sufficient heat resistivity, and thus repeated drying of the magnet ink i after each printing step will not deteriorate the base film.

In the meantime, the aforementioned packaging container information includes, for example, the manufacture lot, date of manufacture, order of manufacture, etc., and they are often read out from the magnetic recording medium layer 13 for the purpose of tracing the distribution route after the product has been placed on a distribution route. Under such circumstances, the information can be read out by unfolding the packaging container 9.

Therefore, the magnetic recording medium layer 13 can be formed on the inner package surface 11*a* of the paper substrate 11, so than it can be read out through a gas-barrier resin layer or a polyethylene layer 14 by placing a read-out unit (not shown) on the inner package surface of the packaging material 10. In such a case, the read-out procedure will be simplified because the magnetic recording medium layer 13 is visible, and applying the read-out unit at the read-out position is made easier. In addition, the polyethylene layer 14 is formed on the inner package surface of the packaging material 10, thus preventing the magnetic recording medium layer 13 and liquid food from contacting each other.

When the magnetic recording medium layer 13 is formed on the inner package surface 11*a* of the paper substrate 11 using a magnetic material having conductivity, another magnetic recording medium layer may be formed at the sealing portions. In this case, the packaging material 10 can be sealed by heating the additional magnetic recording medium layer through induction heating. Furthermore, the packaging material 10 can also be sealed by heating the magnetic recording medium layer 13 itself by induction heating. In other words, the magnetic recording medium layer can also be used as a part for sealing.

The present invention is not limited to the above-described embodiments. Numerous modifications and variations of the present invention are possible in light of the spirit of the present invention, and they are not excluded from the scope of the present invention.

We claim:

1. A filling apparatus for forming a package from a flexible tubular packaging material including a magnetic recording media with filling instructions and sealing instructions encoded thereon and having an interior lined with a heat-sealable resin layer, for filling the formed package and for sealing the filled package, said filling apparatus comprising:

magnetic read means for reading the encoded filling instructions and sealing instructions from the magnetic recording media;

a memory containing a stored program;

control means for generating fill and seal control signals in accordance with the stored program, the read filling instructions and the read sealing instructions;

a filling unit for filling a formed package having a magnetic recording medium with a liquid foodstuff responsive to said fill control signals; and a sealing unit for sealing closed the filled package responsive to said seal control signals.

2. The filling apparatus of claim 1 further comprising:

magnetic write means for receiving container identification data from said filling unit control means and for encoding the received container identification data on the magnetic recording medium of the filled package.

3. The filling apparatus of claim 1 wherein the sealing means is an induction heating unit and wherein the magnetic recording medium is electrically conductive whereby the magnetic recording medium is utilized to generate heat to form a seal.

4. The filling apparatus of claim 1 wherein said seal control signals include signals for sealing time and sealing temperature.

5. A multi-layer tubular packaging material for manufacture of packaging containers comprising:

(a) a substrate;

(b) an inner thermoplastic, heat-sealable resin layer forming an inner package surface;

(c) an outer thermoplastic resin layer forming an outer package surface; and (d) a magnetic recording medium formed as a layer interposed between said substrate and one of said inner and outer thermoplastic resin layers.

6. The multi-layer tubular packaging material of claim 5 wherein said magnetic recording medium is electrically conductive and is positioned on said package for sealing of the package by induction heating.

7. The multi-layer tubular packaging material of claim 5 wherein said substrate is cardboard and wherein said inner and outer thermoplastic resin layers are polyethylene.

* * * * *

UNITED STATES PATENT AND TRADEMARK OFFICE

CERTIFICATE OF CORRECTION

PATENT NO. : 5,704,190

DATED : January 6, 1998

INVENTOR(S) : KANEKO et al

It is certified that error appears in the above-indentified patent and that said Letters Patent is hereby corrected as shown below:

Col. 1, line 57, "packages" should read --packaging--;
line 60, "packages" should read --packaging--; and
line 62, "packages" should read --packaging--.

Col. 5, line 42, delete "the"; delete "installed" insert --provided--;
line 43, delete "any different liquid food to";
line 44, after "container" insert --with any of different liquid foods--; and after "10" insert a comma --,--;
line 55, delete "urethane" insert --polyurethane--;
line 62, delete "varies" and insert --vary--;
line 66, after "selected" insert --to be--.

Col. 6, line 1, before "single" insert --a--;
line 4, delete "layered" insert --layers--;
line 33, delete "to";
line 51, delete "dried and hardened" insert --dry and harden--;
line 67, delete "releasing agent" and insert --release--.

UNITED STATES PATENT AND TRADEMARK OFFICE

CERTIFICATE OF CORRECTION

PATENT NO. : 5,704, 190 Page 2 of 2

DATED : January 6, 1998

INVENTOR(S) : KANEKO et al

It is certified that error appears in the above-indentified patent and that said Letters Patent is hereby corrected as shown below:

Col. 7, line 2, delete "releasing agent" and insert --release--; and line 5, delete "for";

line 33, delete "than" insert --that--.

Title page, and col.1, line 1, change "Aparatus" to --Apparatus--.

Signed and Sealed this

Twenty-ninth Day of December, 1998

*Attest:*

Bruce Lehman

BRUCE LEHMAN

*Attesting Officer*

*Commissioner of Patents and Trademarks*